US006840790B2

(12) United States Patent
Endo et al.

(10) Patent No.: US 6,840,790 B2
(45) Date of Patent: Jan. 11, 2005

(54) CONNECTOR FOR PREVENTING HALF FITTING CONDITION

(75) Inventors: Tomomi Endo, Haibara-gun (JP); Naoto Taguchi, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/614,804

(22) Filed: Jul. 9, 2003

(65) Prior Publication Data

US 2004/0014351 A1 Jan. 22, 2004

(30) Foreign Application Priority Data

Jul. 9, 2002 (JP) ..... P2002-200076

(51) Int. Cl.[7] ..... H01R 13/627
(52) U.S. Cl. ..... 439/352; 439/357
(58) Field of Search ..... 439/352, 353, 439/357, 358

(56) References Cited

U.S. PATENT DOCUMENTS 4,925,398 A * 5/1990 Samejima et al. ..... 439/357
6,343,948 B1 * 2/2002 Nutzel ..... 439/358
6,533,600 B1 * 3/2003 Kashiyama et al. ..... 439/352

FOREIGN PATENT DOCUMENTS

JP 5-190233 A 7/1993
JP 2000-286017 A 10/2000

* cited by examiner

*Primary Examiner*—Alex Gilman
(74) *Attorney, Agent, or Firm*—Sughrue Mion, PLLC

(57) ABSTRACT

A connector includes a first connector, a second connector and a fitting detection member. The first connector includes a tab terminal and a projection. The second connector includes a tab receiving terminal for electrical connection to the tab terminal and an elastic lock arm for sliding over the projection when the second connector is fitted into the first connector. The fitting detection member is mounted on the second connector so as to slide in a direction of fitting of the first and second connectors. The fitting detection member is engaged with the elastic lock arm in a half fitting condition of the first and second connectors. The fitting detection member is slidable to a completely-fitted detecting position in a completely-fitted condition of the male and second connectors. The reduction member which reduce a frictional force generated by a contact between the projection and the elastic lock arm is formed on at least one of the projection and the elastic lock arm.

20 Claims, 5 Drawing Sheets

CONNECTOR FOR PREVENTING HALF FITTING CONDITION

BACKGROUND OF THE INVENTION

This invention relates to a half-fitting prevention connector in which when a pair of male and female connectors are fitted together, a half-fitted condition of the male and female connectors is detected by determining that whether or not a fitting detection member, mounted on one of the two connectors, can be slid into a proper fitting detection position.

FIGS. 4 and 5 show a related half-fitting prevention connector. The half-fitting prevention connector 60, shown in FIGS. 4 and 5, includes a male connector 70, a female connector 80, and a fitting detection member 90.

The female connector 70 includes a tubular portion 71 within which tab terminals 72 are provided, and a projection 73 is formed on the tubular portion 71. The male connector 70 is connected to a connector of a control circuit or the like, and the tab terminals 72 are electrically connected to this control circuit.

The female connector 80 has tab-receiving terminals 81 received therein, and tab holes 82 each for guiding the tab terminal 72 of the male connector 70 into the tab-receiving terminal 81 are formed in a front end of the female connector. A lock arm 83 is formed on the female connector 80, and can be disposed on an outer peripheral face of the tubular portion 71 of the male connector 70, and can be retainingly engaged with the projection 73. The tab-receiving terminals 81 are electrically connected to an electrical equipment part.

The fitting detection member 90 is mounted on the outer periphery of the female connector 80 so as to slide in a direction of fitting of the male and female connectors 70 and 80 relative to each other. The fitting detection member 90 has a retaining arm 91.

In the half-fitting prevention connector 60, when the retaining arm 91 of the fitting detection member 90 is retainingly engaged with the lock arm 83 of the female connector 80, there is achieved an initial condition in which the front end portion of the female connector 80 projects beyond the end of the fitting detection member 90 as shown in FIG. 4. In this initial condition, the lock arm 83 of the female connector 80 is retainingly engaged with the retaining arm 91 of the fitting detection member 90, and therefore the female connector 80 can not slide relative to the fitting detection member 90.

Then, when the tubular portion 71 of the male connector 70 is inserted between the fitting detection member 90 and the female connector 80 as shown in FIG. 5, the projection 73 of the male connector 70 pushes the lock arm 83 up, so that the fitting of the female connector 80 on the male connector 70 proceeds while the lock arm 83 of the female connector 80 slides on the projection 73 of the male connector 70.

In this fitted condition (half-fitted condition), the tab terminals 72 are inserted in the tab holes 83, respectively, but are not yet positively electrically connected to the tab-receiving terminals 81, respectively.

When the fitting of the female connector 80 on the male connector 70 further proceeds, the lock arm 83 of the female connector 80 slides over the projection 73 of the male connector 70, and is brought into retaining engagement with this projection 73. Then, the retaining arm 91 of the fitting detection member 90 slides over the projection 73 of the male connector 70 and the lock arm 83 of the female connector 80, and advances.

As a result, the lock arm 83 of the female connector 80 is held between the projection 73 of the male connector 70 and the retaining arm 91 of the fitting detection member 90, thereby achieving a completely-fitted condition. In this completely-fitted condition, the tab terminals 71 are positively electrically connected to the tab-receiving terminals 81, respectively.

In the above half-fitting prevention connector 60, however, in a case that the connector shifts from the half-fitted condition to the completely-fitted condition, that is, when the lock arm 83 of the female connector 80 slides over the projection 73 of the male connector 70, a frictional force between the lock arm 83 and the projection 73 is large. Therefore, there has been encountered a problem that the advance of the female connector 80 stops, so that the tab terminals 72 are electrically connected respectively to the tab-receiving terminals 81 in an unstable electrical connecting condition.

Particularly when the tab terminals 72 and the tab receiving terminals 81 are used as signal lines so as to feed a very small current, there has been encountered a problem that an error develops.

SUMMARY OF THE INVENTION

It is therefore an object of the present invention to provide a half-fitting prevention connector in which when male and female connectors are disposed in a half-fitted condition, this half-fitted condition can be positively detected.

In order to achieve the above object, according to the present invention, there is provided a connector for preventing a half fitting condition, comprising:

a first connector, including a tab terminal and a projection;

a second connector, including a tab receiving terminal for electrical connection to the tab terminal and an elastic lock arm for sliding over the projection when the second connector is fitted into the first connector; and a fitting detection member, mounted on the second connector so as to slide in a direction of fitting of the first and second connectors, wherein the fitting detection member is engaged with the elastic lock arm in a half fitting condition of the first and second connectors; and wherein the fitting detection member is slidable to a completely-fitted detecting position in a completely-fitted condition of the male and second connectors, wherein a reduction member which reduce a frictional force generated by a contact between the projection and the elastic lock arm is formed on at least one of the projection and the elastic lock arm.

Preferably, the reduction member has a recessed portion which reduces a contact area between the projection and the elastic lock arm during the elastic lock arm slides over the projection.

In the above configuration, in the half-fitted condition before the completely-fitted condition of the first and second connectors, the frictional force between the elastic lock arm and the projection is reduced, and therefore the elastic lock arm can smoothly slide over the projection, and can be elastically deformed upwardly.

Therefore, an elastic restoring force of the elastic lock arm is increased, and a resilient force, tending to urge the female connector back into the half fitting position in the disengaging direction, is produced, so that the half-fitted condition can be positively detected. Therefore, an incompletely-connected condition of the tab terminal and tab receiving terminal in the half-fitted condition can be positively prevented.

Preferably, the recessed portion is formed in a shape that the area thereof is decreased gradually in accordance with a proceeding of the fitting movement of the first and second connector.

Here, it is preferable that, the recessed portion has a curved shape in cross section.

Here, it is preferable that, the recessed portion has either a rectangular shape or a triangular shape in cross section.

Preferably, the reduction member has at least one rib portion.

In the above configuration, even when the fitting of the first and second connectors relative to each other proceeds, the elastic lock arm can smoothly slide toward the distal end of the projection, and can be sufficiently elastically deformed upwardly, and therefore a large resilient force, tending to urge the second connector back into the half fitting position in the disengaging direction, is produced. Therefore, the half-fitted condition before the completely-fitted condition can be positively detected.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
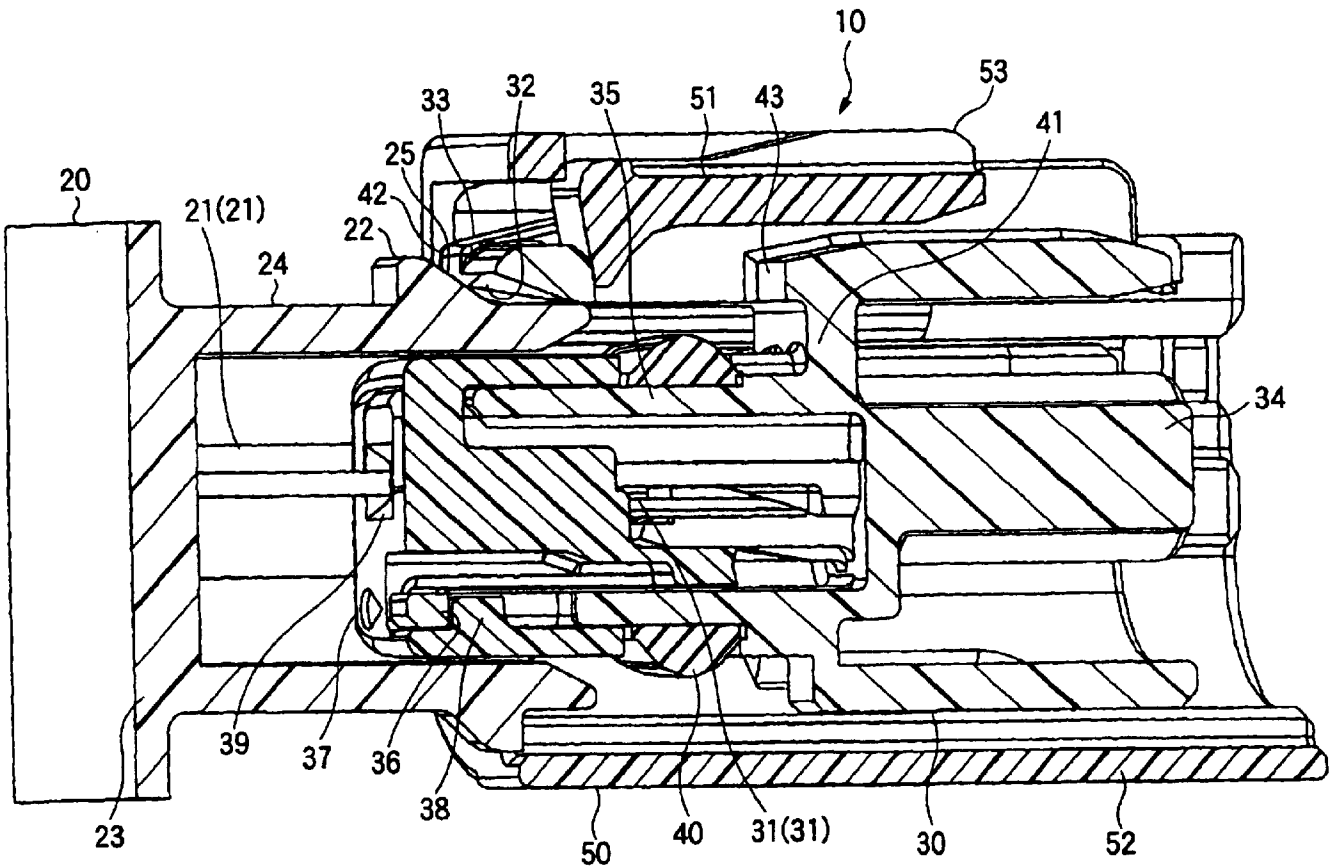
FIG. 1 is a cross-sectional view of one preferred embodiment of a half-fitting prevention connector of the invention, showing an initially-fitted condition of male and female connectors.
Figure 2:
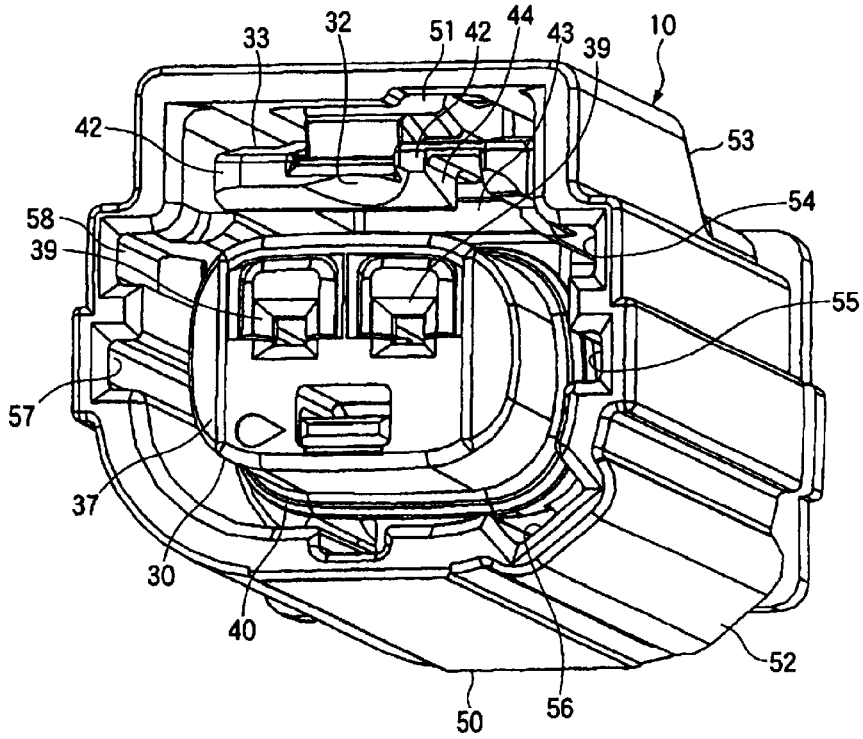
FIG. 2 is a perspective view showing a condition in which a fitting detection member is mounted on the female connector FIG. 1.
Figure 3:
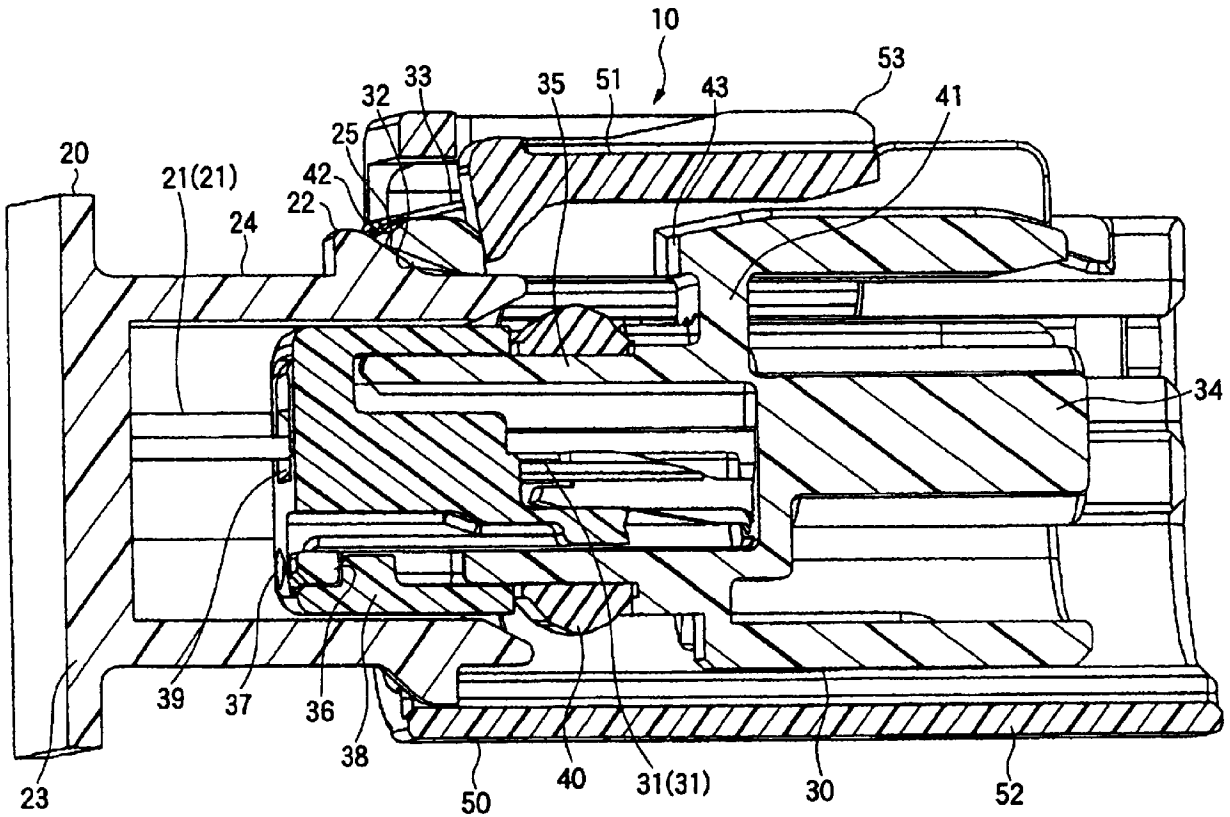
FIG. 3 is a cross-sectional view showing a half-fitted condition of the male and female connectors of FIG. 1.
Figure 4:
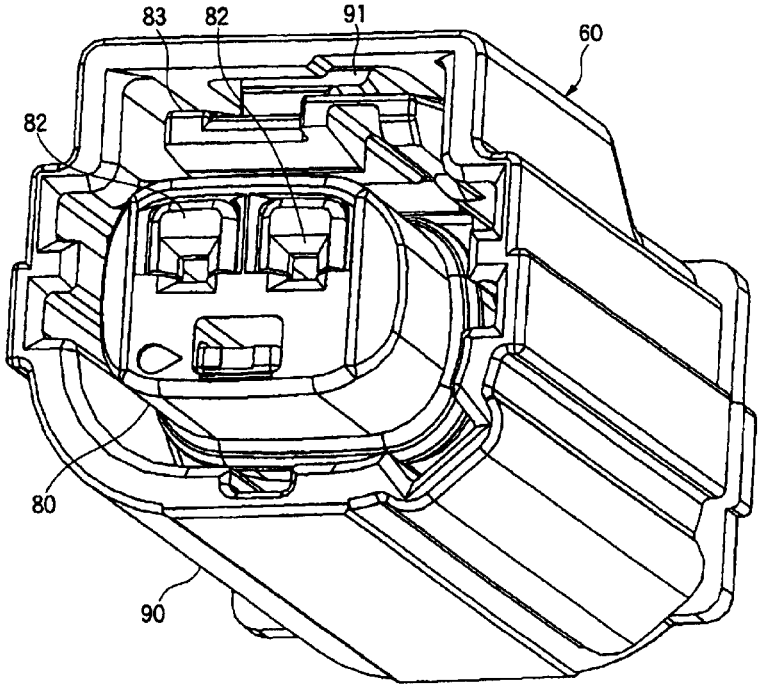
FIG. 4 is a view of a related half-fitting prevention connector, showing the appearance thereof.
Figure 5:
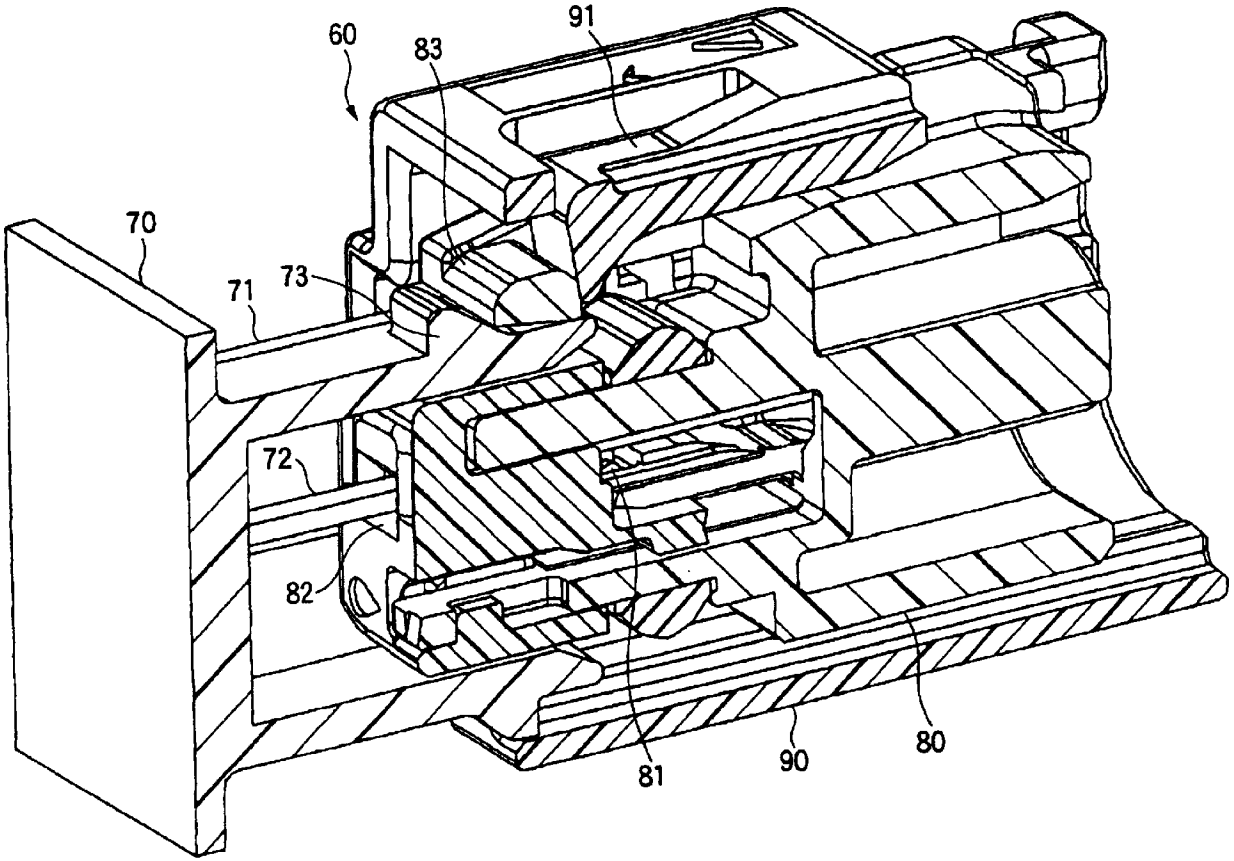
FIG. 5 is a cross-sectional view showing the related half-fitted condition of male and female connectors of FIG. 4.

One preferred embodiment of a half-fitting prevention connector of the present invention will now be described in detail with reference to FIGS. 1 to 3. FIG. 1 is a cross-sectional view of one preferred embodiment of the half-fitting prevention connector of the invention, showing an initially-fitted condition of male and female connectors begin, FIG. 2 is a perspective view showing a condition in which a fitting detection member is mounted on the female connector FIG. 1, and FIG. 3 is a cross-sectional view showing a half-fitted condition of the male and female connectors of FIG. 1 before a completely-fitted condition.

As shown in FIG. 1, the half-fitting prevention connector 10 of this embodiment includes the male connector 20 which has a tab terminals 21 and a projection 22, the female connector 30 which has a tab-receiving terminals 31 and an elastic lock arm 33 having a recessed portion 32, and the fitting detection member 50 which has an elastic retaining arm 51.

The male connector 20 includes a tubular portion 24 projecting from a male connector body 23. One end portion of the tab terminals 21 is projected into the interior of this tubular portion 24. The tubular portion 24 is inserted between the female connector 30 and the fitting detection member 50 mounted on this female connector. A projection-like projection 22 is formed on an upper face of a distal end portion of the tubular portion 24. A lock arm sliding-contact face 25, defined by a slanting flat face, is formed on the projection 22. The lock arm sliding-contact face 25 is abutted against the elastic lock arm 33 of the female connector 30.

The male connector body 23 is electrically connected to a control circuit or the like on board via the other end portions of the tab terminals 21.

As shown in FIGS. 1 and 2, the female connector 30 includes a terminal mounting portion 35 of a generally cylindrical shape projecting from a female connector body 34. The tab-receiving terminals 31 are fitted in this terminal mounting portion 35. A front holder 37 is fitted on the terminal mounting portion 35 in such a manner that an engagement projection 38 of the front holder 37 is retainingly engaged with an engagement portion 36 formed at a distal end of the terminal mounting portion 35. The front holder 37 has tab holes 39 for guiding the tab terminal 21 of the male connector 20 into the tab-receiving terminal 31. A packing 40, made of rubber, is provided between the front holder 37 and the terminal mounting portion 35. The tab-receiving terminals 31 are electrically connected to an electrical equipment part.

The elastic lock arm 33 is supported at its central portion on a support portion 41 protecting from an outer peripheral portion of the female connector body 34, and this elastic lock arm 33 extends along the axis of the female connector body 34. This elastic lock arm 33 can be pivotally moved about the support portion 41 in a seesaw manner, with its front and rear ends moving toward and away from the female connector body 34.

A tongue portion 42 of a generally U-shape is formed at the front end of the elastic lock arm 33. A retaining hole 43 is formed at the inner side of the tongue portion 42 The elastic retaining arm 51 of the fitting detection member 50 is inserted in this retaining hole 43, thereby retaining the female connector 30 relative to the fitting detection member 50. The projection 22 of the male connector 20 is inserted in the retaining hole 43, thereby retaining the female connector 30 relative to the male connector 20.

A guide groove 44 for guiding the fitting movement of the male connector 20 to properly position the same is formed in a lower face of the tongue portion 42 of the elastic lock arm 33.

As shown in FIG. 2, the recessed portion 32 is formed in the lower face of the tongue portion 42 of the elastic lock arm 33 at the distal end portion thereof. This recessed portion 32 is formed into such a concavely-curved face that the area of contact of the lower face of the tongue portion 42 with the projection 22 of the male connector 20 decreases gradually toward the distal end of the lower face of the tongue portion 42. The recessed portion 32 can decrease the area of contact between the elastic lock arm 33 and the projection 22 when the elastic lock arm 33 slides over the projection 22 while the elastic lock arm 33 is brought into contact with the lock arm sliding-contact face 25 of the projection 22.

The elastic retaining arm 51 is provided at an outer peripheral portion of a tubular fitting detection member body 52 of the fitting detection member 50. The elastic retaining arm 51 can be pivotally moved inwardly and outwardly of the periphery of the fitting detection member body 52 through a convex portion 53 projecting from the fitting detection member body 52. Guide grooves 54, 55, 56, 57 and 58 for guiding the fitting movement of the male connector to properly position the same are formed in the inner peripheral face of the fitting detection member body 52, and extend in the fitting direction.

In the half-fitting prevention connector 10, the elastic retaining arm 51 of the fitting detection member 50 is inserted in the retaining hole 43 in the elastic lock arm 33 of the female connector 20, and is retained relative thereto as shown in FIG. 2. As a result, there is achieved an initial condition in which the front holder 37 of the female connector 20 projects beyond the end of the fitting detection member 50.

In this initial condition, the elastic lock arm 33 of the female connector 30 is retainingly engaged with the elastic retaining arm 51 of the fitting detection member 50, and therefore the female connector 30 can not slide relative to the fitting detection member 50.

Then, when the tubular portion 24 of the male connector 20 is inserted between the fitting detection member 50 and the female connector 30 as shown in FIG. 3, the tongue portion 42 of the elastic lock arm 33 of the female connector 20 impinges on the projection 22 of the male connector 20, so that the elastic lock arm 33 is pushed up by the projection 22. And, the fitting of the female connector 30 on the male connector 20 proceeds, so that the tab terminals 21 are inserted respectively into the tab holes 39 and 39 in the front holder 37.

In this half-fitted condition; a frictional force between the elastic lock arm 33 of the female connector 30 and the projection 22 of the male connector 20 is caused by a contact between the recessed portion 32, formed in the lower face of the distal end portion of the tongue portion 42 of the elastic lock arm 33, and the slanting lock arm sliding-contact face 25 of the projection 22.

As described above, the area of contact of the lower face of the tongue portion 42 with the projection 22 is decreased gradually in the direction that the recessed portion 32 proceeds toward a male connector side of the projection 22. Thus the frictional force between the elastic lock arm 33 and the projection 22 is initially decreased as the tongue portion 42 of the elastic lock arm 33 moves alone the distal end of the projection 22. Therefore, a large resilient force, tending to urge the female connector 30 in a disengaging direction away from the male connector 20 to cancel the fitted condition, is produced in the female connector 30, 50 that the half-fitted condition of the male and female connectors 20 and 30 can be positively detected.

Even when the resilient restoring force of the elastic lock arm 33 becomes smaller, the advancing female connector 30 will not be stopped in the half-fitted condition since the large resilient force, tending to urging the female connector 30 away from the male connector 20, is imparted to the female connector 30.

Then, when the fitting of the female connector 30 on the male connector 20 further proceeds, the elastic lock arm 33 of the female connector 30 slides over the projection 22 of the male connector 20, and the projection 22 is retainingly engaged in the retaining hole 43, so that the female connector 30 is completely fitted on the male connector 20.

At this time, the elastic retaining arm 51 of the fitting detection member 50 slides over the projection 22 of the male connector 20 and the elastic lock arm 33 of the female connector 30, and therefore the fitting detection member 50 slides relative to the female connector 30 and the male connector 20, so that the tongue portion 42 of the elastic lock arm 33 is held between the projection 22 of the male connector 20 and the elastic retaining arm 51 of the fitting detection member 50. By this operation, the completely-fitted condition of the male and female connectors 20 and 30 can be detected, and also the tab terminals 21 are positively electrically connected to the tab-receiving terminals 31, respectively.

For disengaging the fitting detection member 50 and the female connector 30 from the male connector 20 in the completely-fitted condition, the fitting detection member 50 is pulled in the disengaging direction opposite to the fitting direction while pressing the proximal end portion of the elastic lock arm 33.

As a result, the retaining engagement of the elastic lock arm 33 and the elastic retaining arm 51 of the fitting detection member 50 with the projection 22 is released. Then, the female connector 30 is slidingly moved into the initial position relative to the fitting detection member 50, and the female connector 30 and the fitting detection member 50 are removed from the male connector 20.

As described above, in the half-fitting prevention connector 10 of this embodiment, thanks to the formation of the recessed portion 32 in the elastic lock arm 33 of the female connector 30, the area of sliding contact of the elastic lock arm 33 with the projection 22 during the sliding of the elastic lock arm 33 over the projection 22 is reduced.

Therefore, in the half-fitted condition of the male connector 20 and the female connector 30 (having the detection fitting member 50 mounted thereon), the frictional force between the elastic lock arm 33 of the female connector 30 and the projection 22 of the male connector 20 is reduced.

Therefore, the elastic lock arm 33 can smoothly slide on the projection 22, and can be elastically deformed upwardly, and therefore the resilient restoring force of the elastic lock arm 33 is increased. Therefore, the resilient force, tending to urge the female connector 30 back into the fitting initial position, is produced, so that the half-fitted condition can be positively detected.

And besides, the area of contact of the lower face of the tongue portion 42, formed in the elastic lock arm 33 of the female connector 30, is decreased gradually toward the distal end of the lower face of the tongue portion 42, and therefore in the half-fitted condition the frictional force between the elastic lock arm 33 and the projection 22 is decreased gradually toward the distal end of the elastic lock arm.

Therefore, even when the fitting of the male and female connectors relative to each other proceeds, the elastic lock arm 33 can smoothly slide up to the distal end of the projection 22, and can be sufficiently elastically deformed upwardly, so that the resilient restoring force of the elastic lock arm 33 is increased. Therefore, a large resilient force, tending to urge the female connector 30 in the disengaging direction into the fitting initial position, is produced, so that the half-fitted condition can be positively prevented.

The half-fitting prevention connector of the present invention is not limited to the above embodiment, and suitable modifications and improvements can be made. Instead of providing the recessed portion in the elastic lock arm of the female connection, this recess portion may be provided in the projection of the male connector, or such recessed portions may be provided in both of the elastic lock arm and the projection, respectively. The recessed portion may have a rectangular shape or a triangular shape.

For reducing the frictional force, a pair of ribs may be formed on both sides portions of a flat face, respectively so that an inner portion between these ribs may be used as a recessed portion.

What is claimed is:

1. A connector for preventing a half fitting condition, comprising:

a first connector comprising a tab terminal and a projection;

a second connector comprising a tab receiving terminal for electrical connection to the tab terminal and an elastic lock arm for sliding over the projection when the second connector is fitted into the first connector; and a fitting detection member, mounted on the second connector so as to slide in a direction of fitting of the first and second connectors, wherein:

the fitting detection member is engaged with the elastic lock aim in a half fitting condition of the first and second connectors;

the fitting detection member is slidable to a completely-fitted detecting position in a completely-fitted condition of the first and second connectors; and a reduction member, which reduces a frictional force generated by contact between the projection and the elastic lock arm, formed on at least one of the projection and the elastic lock arm.

2. The connector as set forth in claim 1, wherein the reduction member has at least one rib portion.

3. The connector as set forth in claim 1, wherein the reduction member comprises a concavity formed in at least one of a first face of the projection and a first face of the elastic lock arm, and the respective first faces of the projection and elastic lock arm slide against one another as the first and second connectors are moved from a half-fitted to a completely-fitted condition.

4. The connector as set forth in claim 3, wherein the elastic lock arm is formed in a cantilever fashion from the second connector, and the portion of the fitting detection member that engages the elastic lock arm is an elastic retaining arm formed in a cantilever fashion from the fitting detection member.

5. The connector as set forth in claim 1, wherein the reduction member comprises a rib formed on at least one of a first face of the projection and a first face of the elastic lock arm, and the respective first faces of the projection and elastic lock arm slide against one another as the first and second connectors are moved from a half-fitted to a completely-fitted condition.

6. The connector as set forth in claim 5, wherein the reduction member comprises two ribs formed on lateral sides of either the first face of the projection or the first face of the elastic lock arm.

7. The connector as set forth in claim 1, wherein:

the fitting detection member is movable from a first position to a second position;

when the fitting detection member is arranged at a first position, the first and second connectors are in the half-fitting condition, and the elastic lock arm is axially outward of, and engaged with, the fitting detection member;

when the fitting detection member is arranged at a second position, the first and second connectors are in a completely-fitted condition, and the elastic lock arm is axially inward of the fitting detection member.

8. The connector as set forth in claim 7, wherein the reduction member comprises a recessed portion formed in at least one of a first face of the projection and a first face of the elastic lock arm, and the respective first faces of the projection and elastic lock arm slide against one another as the first and second connectors are moved from a half-fitted to a completely-fitted condition.

9. The connector as set forth in claim 8, wherein the recessed portion is a U-shaped concavity.

10. The connector as set forth in claim 1, wherein the reduction member comprises a recessed portion formed in at least one of a first face of the projection and a first face of the elastic lock arm, and the respective first faces of the projection and elastic lock arm slide against one another as the first and second connectors are moved from a half-fitted to a completely-fitted condition.

11. The connector as set forth in claim 10, wherein the recessed portion decreases in at least one dimension progressing from a distal to a proximal end of either the projection or the elastic lock arm.

12. The connector as set forth in claim 10, wherein the recessed portion is a U-shaped concavity.

13. The connector as set forth in claim 10, wherein the concavity decreases in at least one dimension progressing from a distal to a proximal end of either the projection or the elastic lock arm.

14. The connector as set forth in claim 1, wherein the reduction member comprises a recessed portion which reduces a contact area between the projection and the elastic lock arm when the elastic lock arm slides over the projection.

15. The connector as set forth in claim 14, wherein the recessed portion is formed in a shape that gradually decreases in contact area between the projection and the elastic look arm during the fitting movement of the first and second connector.

16. The connector as set forth in claim 14, wherein the recessed portion has a curved shape in cross section.

17. The connector as set forth in claim 14, wherein the recessed portion has a rectangular shape in cross section.

18. The connector as set forth in claim 14, wherein the recessed portion has a triangular shape in cross section.

19. A connector for preventing a half fitting condition, comprising:

a first connector comprising a tab terminal and a projection;

a second connector comprising a tab receiving terminal for electrical connection to the tab terminal, and an elastic lock arm;

a fitting detection member mounted on the second connector so that is it slideably movable relative to the second connector from a first position to a second position, wherein:

when the fitting detection member is arranged at a first position, the first and second connectors are in a half-fitting condition, and the elastic lock arm is axially outward of, and engaged with, the fitting detection member;

when the fitting detection member is arranged at a second position, the first and second connectors are in a completely-fitted condition, and the elastic lock arm is axially inward of the fitting detection member;

a friction reducing recess is formed in one of a first face of the projection or a first face of the elastic lock arm; and the respective first faces of the projection and elastic lock arm slide against one another as the first and second connectors are moved from a half-fitted to a completely-fitted condition.

20. The connector as set forth in claim 19, wherein the friction reducing recess decreases in at least one dimension progressing from a distal to a proximal end of either the projection or the elastic lock arm.

* * * * *